US010787973B2

(12) United States Patent
Heinbuch et al.

(10) Patent No.: US 10,787,973 B2
(45) Date of Patent: Sep. 29, 2020

(54) VARIABLE COMPRESSION RATIO ENGINE

(71) Applicant: GM Global Technology Operations LLC, Detroit, MI (US)

(72) Inventors: Ryan M. Heinbuch, Commerce Township, MI (US); Rodney E. Baker, Fenton, MI (US); Justin E. Ketterer, LaSalle (CA)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/266,809

(22) Filed: Feb. 4, 2019

(65) Prior Publication Data

US 2020/0248637 A1 Aug. 6, 2020

(51) Int. Cl.
*F02D 15/02* (2006.01)
*F02B 75/04* (2006.01)
(Continued)

(52) U.S. Cl.
CPC ..... *F02D 15/02* (2013.01); *F02B 75/04* (2013.01); *F02B 75/048* (2013.01); *F02B 75/20* (2013.01);
(Continued)

(58) Field of Classification Search
CPC ..... F02B 75/047; F02B 75/048; F02B 75/04; F02B 69/02; F16H 1/16; F16H 21/20;
(Continued)

(56) References Cited

U.S. PATENT DOCUMENTS

2014/0137824 A1* 5/2014 Jacques ..... F02B 75/048 123/90.17

FOREIGN PATENT DOCUMENTS

DE 102008059870 A1 10/2009
JP 2009085187 A 4/2009

* cited by examiner

*Primary Examiner* — Jacob M Amick

(57) ABSTRACT

A internal combustion engine comprises an engine block defining a cylinder bore, and a piston slideably supported within the cylinder bore. The piston slides reciprocally within the cylinder bore throughout an engine cycle through a piston compression stroke having a compression stroke length and a piston expansion stroke having an expansion stroke length. A crankshaft is rotatably supported by the engine block and rotatable about a crank axis, and a drive gear is co-axially mounted on the crankshaft. A control shaft is rotatably supported by the engine block and rotatable about a control axis that is parallel to and distal from the crank axis. A driven gear is coaxially mounted on the control shaft. A link rod is rotatably connected to the crankshaft and rotatable relative to the crankshaft about an axis that is parallel to and distal from the crank axis. A lower connecting rod has a first end rotatably connected to the link rod, and a second end rotatably connected to the control shaft and is rotatable relative to the control shaft about an axis that is parallel to and distal from the control axis, and an upper connecting rod has a first end rotatably connected to the link rod, and a second end rotatably connected to the piston. A phasing device is supported by the engine block between and interconnecting the crankshaft and the control shaft, and includes an idler shaft rotatable about a phase axis, an electric motor adapted to rotate the idler shaft, a gearbox mounted co-axially on the idler shaft, a crank gear supported on the gearbox co-axial to the idler shaft, and a control shaft gear mounted co-axially on the idler shaft distal from the crank gear. The drive gear engages the crank gear and transfers rotation of the crank shaft to the idler shaft, and the driven gear engages the control shaft gear and transfers rotation of the idler shaft to the control shaft, and when the electric motor rotates the idler shaft, the gearbox is adapted to allow the rotational speed of the idler shaft to change
(Continued)

relative to the rotational speed of the crank shaft to change the rotational speed of the control shaft relative to the crankshaft and change the clearance volume.

18 Claims, 4 Drawing Sheets

(51) Int. Cl.
*F02B 75/20* (2006.01)
*F02D 41/00* (2006.01)
*F02D 13/02* (2006.01)

(52) U.S. Cl.
CPC .... *F02D 13/0269* (2013.01); *F02D 2041/001* (2013.01)

(58) Field of Classification Search
CPC ..... F16H 19/001; F02D 15/00; F02D 15/02; F02D 15/04
See application file for complete search history.

VARIABLE COMPRESSION RATIO ENGINE

INTRODUCTION

The present disclosure relates to an internal combustion engine having the ability to operate with the advantages of the Atkinson cycle and also provide the ability to vary the compression ratio of the engine.

Internal combustion engines operating on an Atkinson cycle are known. An engine operating on an Atkinson cycle has a compression stroke length that is less than the expansion stroke length, during both high load and high engine speed conditions and low load and low engine speed conditions. This provides fuel economy benefits.

In addition to the operating on an Atkinson cycle, it is advantageous to be able to change the compression ratio of an internal combustion engine. While the ability to do this exists, technologies allowing this can add cost and weight to a vehicle and increase packaging requirements for the engine.

Thus, while current technologies achieve their intended purpose, there is a need for a new and improved internal combustion engine that provides the benefits of operating on an Atkinson cycle and provides the ability to selectively vary the compression ratio of the engine.

SUMMARY

According to several aspects of the present disclosure, an internal combustion engine comprises an engine block defining a cylinder bore, a piston slideably supported within the cylinder bore, a crankshaft rotatably supported by the engine block and rotatable about a crank axis, a control shaft rotatably supported by the engine block and rotatable about a control axis, wherein the control axis is parallel to and distal from the crank axis, a link rod rotatably connected to the crankshaft and rotatable relative to the crankshaft about an axis that is parallel to and distal from the crank axis, a lower connecting rod having a first end rotatably connected to the link rod, and a second end rotatably connected to the control shaft and rotatable relative to the control shaft about an axis that is parallel to and distal from the control axis, an upper connecting rod having a first end rotatably connected to the link rod, and a second end rotatably connected to the piston; and a phasing device supported by the engine block between and interconnecting the crankshaft and the control shaft and rotates the control shaft at a rotational speed relative to the rotational speed of the crankshaft and can selectively vary the ratio of the rotational speed of the control shaft to the rotational speed of the crankshaft.

According to several aspects of the present disclosure, an internal combustion engine includes an engine block defining a cylinder bore, a piston slideably supported within the cylinder bore, wherein the piston slides reciprocally within the cylinder bore throughout an engine cycle, including a piston compression stroke having a compression stroke length and a piston expansion stroke having an expansion stroke length. A crankshaft is rotatably supported by the engine block and rotatable about a crank axis, and a control shaft is rotatably supported by the engine block and rotatable about a control axis. The control axis is parallel to and distal from the crank axis. A link rod is rotatably connected to the crankshaft and rotatable relative to the crankshaft about an axis that is parallel to and distal from the crank axis. A lower connecting rod has a first end rotatably connected to the link rod, and a second end rotatably connected to the control shaft. The lower connecting rod is rotatable relative to the control shaft about an axis that is parallel to and distal from the control axis. An upper connecting rod has a first end rotatably connected to the link rod, and a second end rotatably connected to the piston. A phasing device is supported by the engine block between and interconnecting the crankshaft and the control shaft and selectively changes the rotational speed of the control shaft relative to the crankshaft, thereby changing the compression stroke length of the piston compression stroke.

In another aspect of the present disclosure, internal combustion engine further comprises a drive gear co-axially mounted on the crankshaft and a driven gear co-axially mounted on the control shaft, and the phasing device includes an idler shaft rotatable about a phase axis, a gearbox mounted co-axially on the idler shaft, a crank gear supported on the gearbox co-axial to the idler shaft, and a control shaft gear mounted co-axially on the idler shaft distal from the crank gear, wherein the drive gear engages the crank gear and transfers rotation of the crank shaft to the idler shaft, and the driven gear engages the control shaft gear and transfers rotation of the idler shaft to the control shaft.

In another aspect of the present disclosure, the phasing device includes an electric motor connected to the idler shaft and adapted to rotate the idler shaft.

In another aspect of the present disclosure, the gear box is adapted to allow the rotational speed of the idler shaft relative to the rotational speed of the crank gear to change when the idler shaft is being rotated by the electric motor.

In another aspect of the present disclosure, the electric motor is adapted to induce rotation of the idler shaft in a first direction, wherein the rotational speed of the idler shaft is increased relative to the rotational speed of the crank gear, or a second direction, wherein the rotational speed of the idler shaft is decreased relative to the rotational speed of the crank gear.

In another aspect of the present disclosure, crank gear, the gear box, the idler shaft and the control shaft gear rotate unitarily unless the idler shaft is rotated by the electric motor.

In another aspect of the present disclosure, a gear ratio between the drive gear and the crank gear is 2:1, and a gear ratio between the control shaft gear and the driven gear is 1:1, and wherein, when there is no input from the electric motor the control shaft rotates at one half the rotational speed of the crankshaft.

In another aspect of the present disclosure, a gear ratio between the drive gear and the crank gear is 2:1, a gear ratio between the control shaft gear and the driven gear is 1:1, and the gear ratio of the gearbox is 1:1, and wherein, without input from the electric motor the control shaft rotates at one half the rotational speed of the crankshaft.

In another aspect of the present disclosure, a gear ratio between the drive gear and the crank gear is 1:1, a gear ratio between the control shaft gear and the driven gear is 1:1, and the gear ratio of the gearbox is 2:1, and wherein, without input from the electric motor the control shaft rotates at one half the rotational speed of the crankshaft.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
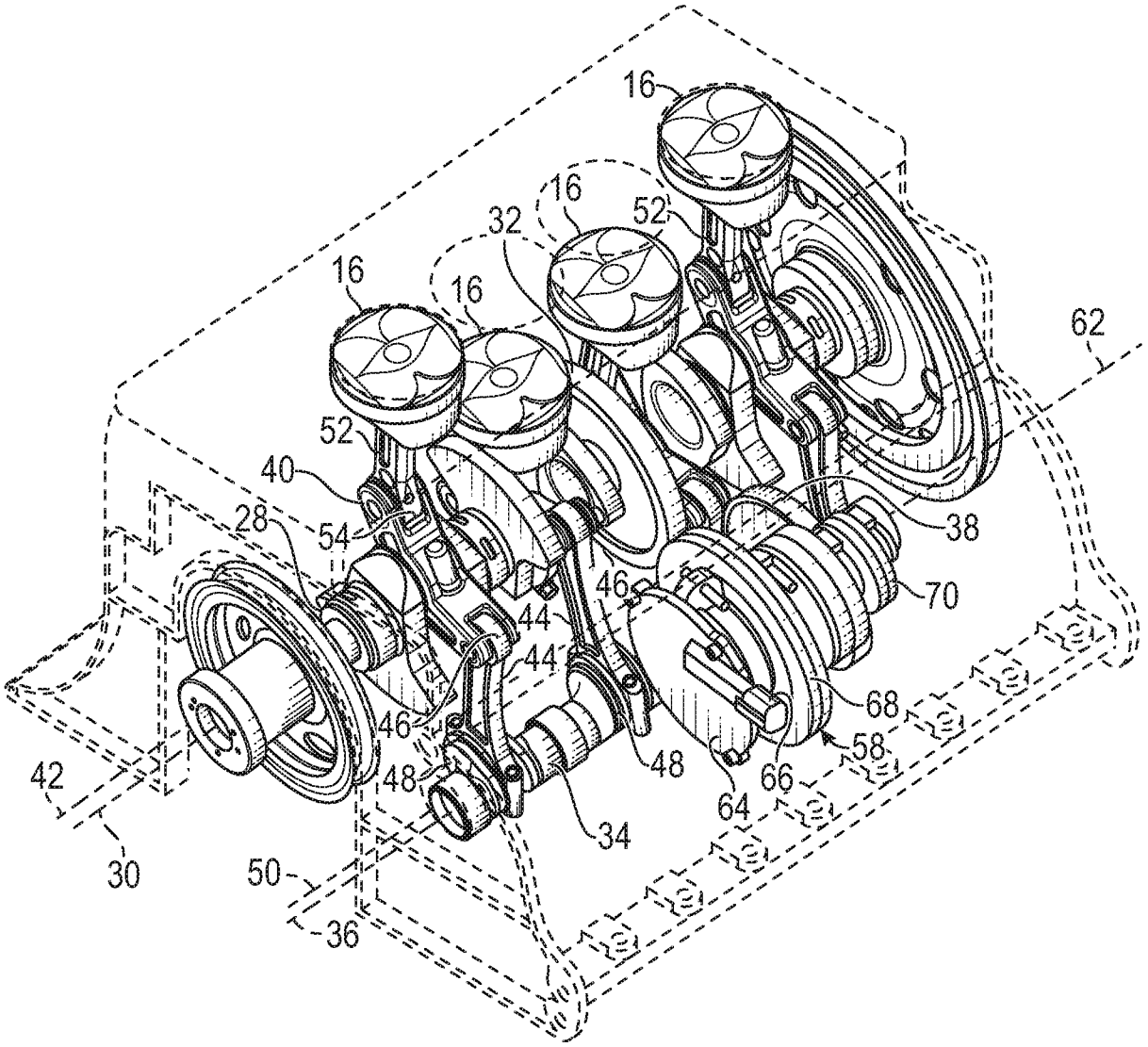
FIG. 1 is a perspective view of an internal combustion engine according to an exemplary embodiment, with the engine block shown partially broken away.
Figure 2:
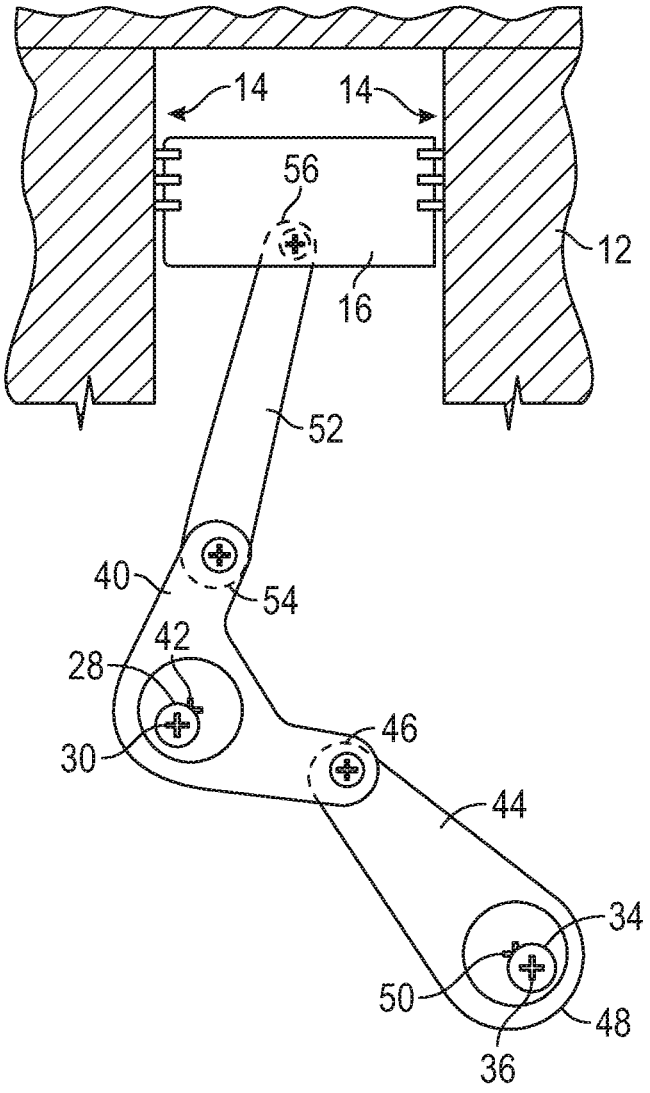
FIG. 2 is a sectional view taken from FIG. 1 along line 2-2.

Referring to FIGS. 1 and 2, an internal combustion engine according to an exemplary embodiment of the present disclosure is shown generally at 10. The internal combustion engine 10 includes an engine block 12. The engine block 12 defines at least one cylinder bore 14 formed therein. A piston 16 is slideably supported within the cylinder bore 14. While FIG. 1 shows an internal combustion engine 10 with four cylinder bores 14 and four pistons 16, it should be appreciated that the engine block 12 may be configured to include different multiples of cylinder bores 14. For example, the engine block 12 may be configured as a V-style engine having 2, 4, 6, 8, or 10 cylinder bores 14, or as an inline style engine having one or more cylinder bores 14. It should be appreciated that the engine block 12 may be configured in a manner other than the exemplary V-style or inline style engines noted above, and may include any number of cylinder bores 14 other than the exemplary numbers described herein. The piston 16 slides back and forth reciprocally within the cylinder bore 14 throughout an engine cycle 18, including a piston compression stroke 20 having a compression stroke length 22 and a piston expansion stroke 24 having an expansion stroke length 26.

A crankshaft 28 is rotatably supported by the engine block 12 and rotates about a crankshaft axis 30. The crankshaft 28 includes a drive gear 32 co-axially mounted thereon. A control shaft 34 is rotatably supported by the engine block 12 and rotates about a control shaft axis 36 that is parallel to and distal from the crank axis 30. The control shaft 34 includes a driven gear 38 co-axially mounted thereon. A link rod 40 is rotatably supported on the crankshaft 28 and rotatable relative to the crankshaft 28 about a link rod axis 42 that is parallel to and distal from the crankshaft axis 30. A lower connecting rod 44 has a first end 46 that is rotatably connected to the link rod 40, and a second end 48 that is rotatably connected to the control shaft 34. The lower connecting rod 44 is rotatable relative to the control shaft 34 about a lower connecting rod axis 50 that is parallel to and distal from the control shaft axis 36. An upper connecting rod 52 has a first end 54 rotatably connected to the link rod 40, and a second end 56 rotatably connected to the piston 16.

A phasing device 58 is supported by the engine block 12 between and interconnecting the crankshaft 28 and the control shaft 34. The phasing device 58 is adapted to selectively change the rotational speed of the control shaft 34 relative to the crankshaft 28 and changes the clearance volume within the cylinder bore 14 above the piston 16.

Figure 3:
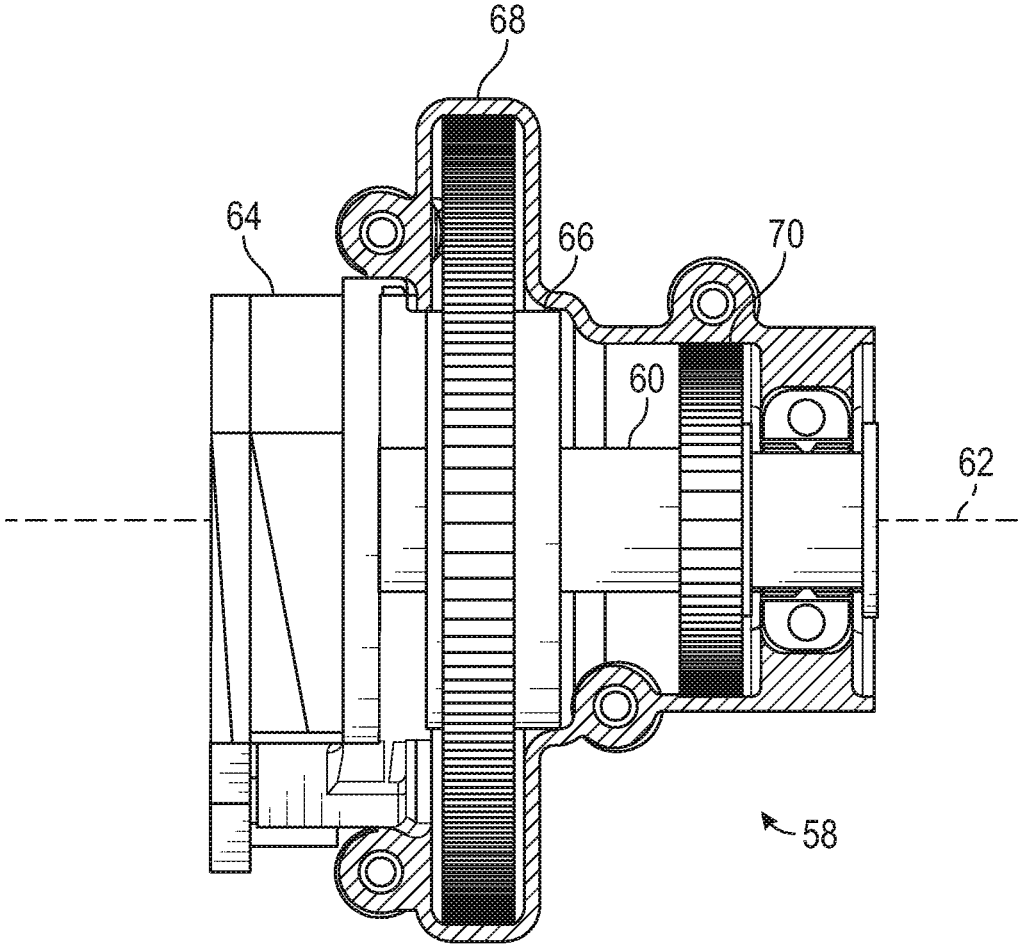
FIG. 3 is a phasing device for an internal combustion engine according to an exemplary embodiment.

Referring to FIG. 3, the phasing device 58 include an idler shaft 60 rotatable about an idler axis 62 that is parallel to and spaced from both the crankshaft axis 30 and the control shaft axis 36. An electric motor 64 is connected to the idler shaft 60 and selectively rotates the idler shaft 60 about the idler axis 62. A gearbox 66 is mounted co-axially on the idler shaft 60. A crank gear 68 is supported on the gearbox 66 co-axial to the idler shaft 60. A control shaft gear 70 is mounted co-axially on the idler shaft 60 distal from the crank gear 68.

The drive gear 32 is fixedly mounted onto the crankshaft 28 and rotates along with the crankshaft 28. The drive gear 32 engages the crank gear 68 and transfers rotation of the crank shaft 28 to the idler shaft 60. The driven gear 38 is fixedly mounted onto the control shaft 34 and the control shaft gear 70 is fixedly mounted onto the idler shaft 60. When the crankshaft 28 rotates, rotational motion is transferred from the crankshaft 28 through the drive gear 32, crank gear 68 and gearbox 66 to rotate the idler shaft 60. When the idler shaft 60 rotates, rotational motion is transferred from the idler shaft 60 through the control shaft gear 70 and driven gear 38 to rotate the control shaft 34. In this way, the control shaft 34 rotates in relation to the crankshaft 28.

The gear box 66 is adapted to allow the rotational speed of the idler shaft 60 relative to the rotational speed of the crank gear 68 to change when the electric motor 64 acts on the idler shaft 60. It should be understood that the gear box 66 may be any high ratio device adapted to interconnect the crank gear 68 and the idler shaft 60. For example, the gearbox could be a harmonic drive, a planetary gearset, or roller reducer. These examples are exemplary in nature and are not intended to limit the scope of this disclosure.

The electric motor 64 can induce rotation of the idler shaft 60 in a first, or clockwise direction or in a second, counter-clockwise direction. The idler shaft 60 rotates at a given rotational speed due to input from the crank gear 68. If the electric motor 64 acts to rotate the idler shaft 60 in the same direction that the idler shaft 60 is already rotating, the additional rotational input from the electric motor 64 will cause the idler gear 60 to speed up. Alternatively, if the electric motor 64 acts to rotate the idler shaft 60 in the opposite direction, the force of the electric motor 64 will work against the rotation of the idler shaft 60 and cause the idler shaft 60 to slow down. Thus, the electric motor 64 can selectively cause the rotational speed of the idler shaft 60, and consequently, the rotational speed of the control shaft 34 to speed up or slow down relative to the rotational speed of the crankshaft 28.

The link rod 40 is rotatably supported on the crankshaft 28 and rotatable relative to the crankshaft 28 about the link rod axis 42. The eccentric connection between the link rod 40 and the crankshaft 28 causes the link rod 40 to move as the crankshaft 28 rotates. The first end 46 of the lower connecting rod 44 is rotatably connected to the link rod 40, and the second end 48 is rotatably connected to the control shaft 34. The lower connecting rod 44 is rotatable relative to the control shaft 34 about the lower connecting rod axis 42. Due to the eccentric connection of the second end 48 of the lower connecting rod 48 and the control shaft 34, rotation of the control shaft 34 about the control shaft axis 36 causes the lower connecting rod 44 to act upon the link rod 40 and affects the pattern or path of the link rod 40.

Figure 4:
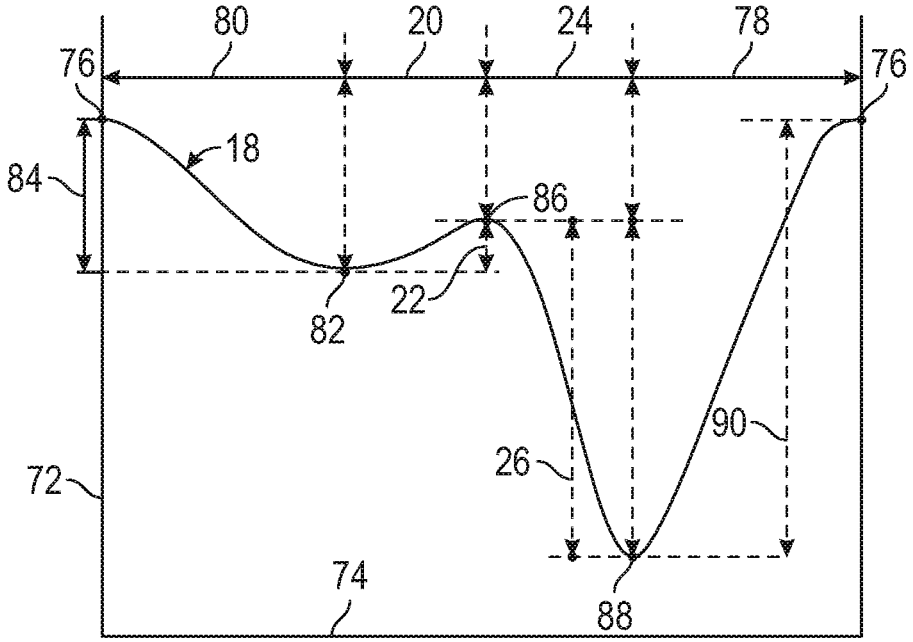
FIG. 4 is graphical representation of an engine cycle for an internal combustion engine according to an exemplary embodiment.

The motion of the link rod 40 due to the rotation of the crankshaft 28 and input from rotation of the control shaft 34 controls the reciprocating motion of the piston 16 within the cylinder bore 14. Referring to FIG. 4, an engine cycle 18 of an internal combustion engine 10 is graphically represented. The position of the piston 16 is generally shown along a vertical axis 72, and the stage or time duration of the cycle is generally shown along a horizontal axis 74. A top dead center position 76 is the position of the piston 16 at the end of an exhaust stroke 78 and at a beginning of an intake stroke 80. FIG. 4 is a graphical representation of a complete cycle of the piston 16. The top dead center position 76 of the piston 16 at the end of the exhaust stroke 78 and the beginning of the intake stroke 80 occurs at both the far left and far right ends of the engine cycle 18.

Beginning at the top dead center position 76 of the piston 16 at the far left side of the engine cycle 18, the piston 16 moves downward within the cylinder bore 14 and begins the intake stroke 80. During the intake stroke, an intake valve in the cylinder head is opened to allow fuel and combustion air to enter the cylinder bore 14. The end of the intake stroke 80 occurs at point 82. During the intake stroke 80, the distance the piston 16 travels between the top dead center position 76 and the end of the intake stoke 82 is an intake stroke length 84. At the end of the intake stroke 82, the intake valve closes and the piston 16 changed direction and begins moving upward within the cylinder bore 14, beginning the piston compression stroke 20. The piston compression stroke 20 ends at point 86. The distance the piston 16 travels during the compression stroke 20 is the compression stroke length 22.

At the end of the piston compression stroke 20, the fuel air mixture is ignited and the piston 16 begins moving downward and begins the piston expansion stroke 24. During the piston expansion stroke 24 the ignited fuel air mixture rapidly expands and forces the piston 16 downward within the cylinder bore 14. The end of the piston expansion stroke 24 occurs at point 88. The expansion stroke length 26 is the distance the piston 16 travels within the cylinder bore 14 during the piston expansion stroke 24. Near the end 88 of the piston expansion stroke 24, an exhaust valve is opened in the cylinder head and the piston 16 begins moving upward in the cylinder bore 14 to force the combusted gases to exhaust through the exhaust valve. This begins the exhaust stroke 78. The end of the exhaust stroke occurs at the top dead center position 76 of the piston 16, shown at the far right of the engine cycle 18. The distance the piston 16 travels within the cylinder bore 16 during the exhaust stroke 78 is the exhaust stroke length 90.

In a steady state condition, the rotational speed of the control shaft 34 relative to the rotational speed of the crankshaft 28 is constant and the position of the second end 48 of the lower connecting rod 44 is always at the same position relative to any given point in the engine cycle 18. The electric motor 64 of the phasing device 58 can be used to temporarily speed up or slow down the rotational speed of the control shaft 34 relative to the rotational speed of the crank shaft 28. Afterward, electric motor 64 is turned off, the rotational speed of the control shaft 34 relative to the rotational speed of the crankshaft 28 is once again constant again. However, after temporarily varying the rotation speed of the control shaft relative to the rotational speed of the crankshaft, the position of the second end 48 of the lower connecting rod 44 is rotationally shifted, or "phased". This means that the rotational position of the second end 48 of the connecting rod 44 about the control shaft axis 36 relative to the position of the crankshaft 28 at any given point during the engine cycle 18 after being phased is different than the rotational position of the second end 48 of the connecting rod 44 about the control shaft axis 36 relative to the position of the crankshaft 28 at that same point during the engine cycle 18 prior to being phased.

The compression stroke length 22 is less than the expansion stroke length 26. By changing the position of the lower connecting rod 44, the movement or path that the link rod 40 follows is altered, which changes the compression stroke length 22, but more importantly, changes the clearance volume within the cylinder bore 14 above the piston 16. By changing the compression stroke length 22 of the piston 16, the compression ratio of the internal combustion engine is changed. By changing the clearance volume, the compression ratio of the internal combustion engine 10 that occurs during the compression stroke 20 is reduced. A small change in the clearance volume results in a large change in compression ratio. Accordingly, by controlling the position of the lower connecting rod 44, the compression ratio of the internal combustion engine 10 may be controlled and changed between a high compression ratio during certain engine operating conditions, and a low compression ratio during other engine operating conditions. The internal combustion engine 10 described herein provides a variable compression ratio engine that enables the use of an Atkinson cycle, in which the compression stroke length 22 is less than the expansion stroke length 26, in both high load and high engine speed conditions and low load and low engine speed conditions, to achieve the fuel economy benefits that may be realized from the Atkinson cycle for all operating conditions of the internal combustion engine 10.

The optimal ratio between the rotational speed of the crankshaft 28 and the rotational speed of the control shaft 34 during a steady state condition may not be 1:1. In an exemplary embodiment, the gear box 66 allows no relative rotation between the idler shaft 60 and the crank gear 68 unless there is input from the electric motor 64. The crank gear 68, the gear box 66, the idler shaft 60 and the control shaft gear 70 rotate unitarily unless the electric motor 64 intercedes and causes the idler shaft 60 to speed up or slow down relative to the crank gear 68. The gear ratio between the drive gear 32 and the crank gear is 2:1, and the gear ratio between the control shaft gear 70 and the driven gear 38 is 1:1. In the absence of input from the electric motor 64, the control shaft 34 rotates at one half the rotational speed of the crankshaft 28.

In another exemplary embodiment, the gear box 66 allows no relative rotation between the idler shaft 60 and the crank gear 68 unless there is input from the electric motor 64. The crank gear 68, the gear box 66, and the idler shaft 60 do not rotate unitarily, but the gear ratio of the gear box 66 is 1:1, unless the electric motor 64 intercedes and causes the idler shaft 60 to speed up or slow down relative to the crank gear 68. The gear ratio between the drive gear 32 and the crank gear is 2:1, and the gear ratio between the control shaft gear 70 and the driven gear 38 is 1:1. In the absence of input from the electric motor 64, the control shaft 34 rotates at one half the rotational speed of the crankshaft 28.

In another exemplary embodiment, the gear box 66 has a gear ratio of 2:1, unless there is input from the electric motor 64. The gear ratio between the drive gear 32 and the crank gear 68 is 1:1, and the gear ratio between the control shaft gear 70 and the driven gear 38 is 1:1. In the absence of input from the electric motor 64, the control shaft 34 rotates at one half the rotational speed of the crankshaft 28.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. An internal combustion engine comprising:

an engine block defining a cylinder bore;

a piston slideably supported within the cylinder bore, wherein the piston slides reciprocally within the cylinder bore throughout an engine cycle, including a piston compression stroke having a compression stroke length and a piston expansion stroke having an expansion stroke length;

a crankshaft rotatably supported by the engine block and rotatable about a crank axis;

a control shaft rotatably supported within the engine and rotatable about a control axis, wherein the control axis is parallel to and distal from the crank axis;

a link rod rotatably and eccentrically connected to the crankshaft;

a lower connecting rod having a first end rotatably connected to the link rod, and a second end rotatably and eccentrically connected to the control shaft;

an upper connecting rod having a first end rotatably connected to the link rod, and a second end rotatably connected to the piston; and a phasing device supported within the engine between and interconnecting the crankshaft and the control shaft, wherein the phasing device selectively changes the rotational speed of the control shaft relative to the crankshaft and changes the compression stroke length of the piston compression stroke; and a drive gear co-axially mounted on the crankshaft and a driven gear co-axially mounted on the control shaft, wherein the phasing device includes an idler shaft rotatable about an axis, a gearbox mounted co-axially on the idler shalt, a crank gear supported on the gearbox co-axial to the idler shaft, and a control shaft gear mounted co-axially on the idler shaft distal from the crank gear, and wherein the drive gear engages the crank gear and transfers rotation of the crank shaft to the idler shaft, and the driven gear engages the control shaft gear and transfers rotation of the idler shaft to the control shaft.

2. The internal combustion engine of claim 1, wherein the link rod is rotatable relative to the crankshaft about an axis that is parallel to and distal from the crank axis.

3. The internal combustion engine of claim 2, wherein the lower connecting rod is rotatable relative to the control shaft about an axis that is parallel to and distal from the control axis.

4. The internal combustion engine of claim 3, wherein the gearbox is one of a harmonic drive, a planetary gearset, and a roller reducer.

5. The internal combustion engine of claim 4, wherein the phasing device includes an electric motor connected to the idler shaft and adapted to rotate the idler shaft.

6. The internal combustion engine of claim 5, wherein the gear box is adapted to allow the rotational speed of the idler shaft relative to the rotational speed of the crank gear to change when the idler shaft is being rotated by the electric motor.

7. The internal combustion engine of claim 6, wherein the electric motor is adapted to induce rotation of the idler shaft in a first direction, wherein the rotational speed of the idler shaft is increased relative to the rotational speed of the crank gear, or a second direction, wherein the rotational speed of the idler shaft is decreased relative to the rotational speed of the crank gear.

8. The internal combustion engine of claim 7, wherein without input from the electric motor the crank gear, the gear box, the idler shaft and the control shall gear rotate unitarily.

9. The internal combustion engine of claim 8, wherein a gear ratio between the drive gear and the crank gear is 2:1, and a gear ratio between the control shaft gear and the driven gear is 1:1, and wherein, when there is no input from the electric motor the control shaft rotates at one half the rotational speed of the crankshaft.

10. The internal combustion engine of claim 7, wherein a gear ratio between the drive gear and the crank gear is 2:1, a gear ratio between the control shaft gear and the driven gear is 1:1, and the gear ratio of the gearbox is 1:1, and wherein, without input from the electric motor the control shaft rotates at one half the rotational speed of the crankshaft.

11. The internal combustion engine of claim 7, wherein a gear ratio between the drive gear and the crank gear is 1:1 a gear ratio between the control shaft gear and the driven gear is 1:1 and the gear ratio between the crank gear and the control shaft gear is 2:1, and wherein, without input from the electric motor the control shaft rotates at one half the rotational speed of the crankshaft.

12. An internal combustion engine comprising:

an engine block defining a cylinder bore;

a piston slideably supported within the cylinder bore, wherein the piston slides reciprocally within the cylinder bore throughout an engine cycle, including a piston compression stroke having a compression stroke length and a piston expansion stroke having an expansion stroke length;

a crankshaft rotatably supported by the engine block and rotatable about a crank axis;

a drive gear co-axially mounted on the crankshaft;

a control shaft rotatably supported by the engine block and rotatable about a control axis, wherein the control axis is parallel to and distal from the crank axis;

a driven gear coaxially mounted on the control shaft;

a link rod rotatably and eccentrically connected to the crankshaft and rotatable relative to the crankshaft about an axis that is parallel to and distal from the crank axis;

a lower connecting rod having a first end rotatably connected to the link rod, and a second end rotatably and eccentrically connected to the control shaft, the lower connecting rod being rotatable relative to the control shaft about an axis that is parallel to and distal from the control axis;

an upper connecting rod having a first end rotatably connected to the link rod, and a second end rotatably connected to the piston, and a phasing device supported by the engine block between and interconnecting the crankshaft and the control shaft, the phasing device including an idler shaft rotatable about a phase axis, an electric motor adapted to rotate the idler shaft, a gearbox mounted co-axially on the idler shaft, a crank gear supported on the gearbox co-axial to the idler shaft, and a control shaft gear mounted co-axially on the idler shaft distal from the crank gear, wherein the drive gear engages the crank gear and transfers rotation of the crank shaft to the idler shaft, and the driven gear engages the control shaft gear and transfers rotation of the idler shaft to the control shaft, and wherein when the electric motor rotates the idler shaft, the gearbox is adapted to allow the rotational speed of the idler shaft to change relative to the rotational speed of the crank shaft to change the rotational speed of the control shaft relative to the crankshaft and change the compression stroke length of the piston compression stroke.

13. The internal combustion engine of claim 12, wherein the gearbox is one of a harmonic drive, a planetary gearset, and a roller reducer.

14. The internal combustion engine of claim 13, wherein the electric motor is adapted to induce rotation of the idler shaft in a first direction, wherein the rotational speed of the idler shaft is increased relative to the rotational speed of the crank gear, or a second direction, wherein the rotational speed of the idler shaft is decreased relative to the rotational speed of the crank gear.

15. The internal combustion engine of claim 14, wherein without input from the electric motor the crank gear, the gear box, the idler shaft and the control shaft gear rotate unitarily.

16. The internal combustion engine of claim 15, wherein a gear ratio between the drive gear and the crank gear is 2:1, and a gear ratio between the control shaft gear and the driven gear is 1:1, and wherein, when there is no input from the electric motor the control shaft rotates at one half the rotational speed of the crankshaft.

17. The internal combustion engine of claim 14, wherein a gear ratio between the drive gear and the crank gear is 2:1, a gear ratio between the control shaft gear and the driven gear is 1:1, and the gear ratio between the crank gear and the control shaft gear is 1:1 and wherein, without input from the electric motor the control shaft rotates at one half the rotational speed of the crankshaft.

18. The internal combustion engine of claim 14, wherein a gear ratio between the drive gear and the crank gear is 1:1, a gear ratio between the control shaft gear and the driven gear is 1:1, and the gear ratio between the crank gear and the control shaft gear is 2:1 and wherein, without input from the electric motor the control shaft rotates at one half the rotational speed of the crankshaft.

* * * * *